US006877803B1

(12) United States Patent
Reese

(10) Patent No.: US 6,877,803 B1
(45) Date of Patent: Apr. 12, 2005

(54) FOLDABLE ROCKING CHAIR

(76) Inventor: Bejamin P. Reese, 20777 Mountain Dr., San Jose, CA (US) 95120

( * ) Notice: Subject to any disclaimer, the term of this patent is extended or adjusted under 35 U.S.C. 154(b) by 0 days.

(21) Appl. No.: 10/680,231

(22) Filed: Oct. 8, 2003

(51) Int. Cl.[7] ..... A47C 4/24

(52) U.S. Cl. ..... 297/18; 297/440.24; 297/56; 297/35

(58) Field of Search ..... 297/18, 35, 55, 297/56, 284.3, 284.5, 284.7, 440.11, 440.1, 440.24

(56) References Cited

U.S. PATENT DOCUMENTS

| | | | | | |
|---|---|---|---|---|---|
| 1,694,933 | A | * | 12/1928 | Walker et al. | 297/18 |
| RE20,384 | E | * | 5/1937 | Stockil | 297/18 |
| 2,564,915 | A | * | 8/1951 | Nelson | 297/287 |
| 2,694,438 | A | * | 11/1954 | French | 297/440.11 |
| 2,741,298 | A | * | 4/1956 | Roberts, III | 297/18 |
| 3,279,849 | A | * | 10/1966 | Radke et al. | 297/284.5 |
| 3,338,625 | A | * | 8/1967 | Jung-Shien | 297/18 |
| 6,398,298 | B1 | * | 6/2002 | Chen | 297/41 |

FOREIGN PATENT DOCUMENTS

| | | | | |
|---|---|---|---|---|
| GB | 2113083 | * | 8/1983 | 297/18 |

* cited by examiner

*Primary Examiner*—Peter R. Brown
(74) *Attorney, Agent, or Firm*—Birch, Stewart, Kolasch & Birch, LLP.

(57) ABSTRACT

A foldable rocking chair includes a chair frame comprised of first and second U-shaped members each having opposite side bars connected by a bottom bar and arranged to cross each other, a stretcher bar having opposite ends pivoted to the side bars at a location below the crossing of the side bars, an armrest in the form of an L-shape pivoted to the side bars at a location above the crossing of the side bars and a primary cross bar extending between and fixed to free ends of the side bars of the first U-shaped member and adjacent to the pivot connection between the armrest and the side bars whereby when the side bars of the first U-shaped member are rocked frontward, the armrests are moved toward and eventually contact the primary cross bar to stop the frontward rocking motion of the first U-shaped member. A flexible sheet is attached to the chair frame with adjustable headrest and adjustable lower back rest cushions for supporting a person thereon.

7 Claims, 6 Drawing Sheets

FOLDABLE ROCKING CHAIR

BACKGROUND OF THE INVENTION

1. Field of the Invention

The present invention relates generally to a rocking chair, and in particular to a foldable structure of rocking chair.

2. The Related Art

A conventional rocking chair comprises two concave bars mounted on bottoms of chair legs. A person sitting on the rocking chair may move his or her center of gravity back and forth to cause rocking motion of the chair. Such a conventional rocking chair is not collapsible and thus, it occupies a great amount of space, even it is not in use.

Collapsible rocking chairs are also available, such as U.S. Pat. No. 6,398,298B1, which comprises two pairs of rods crossing but not jointed to each other. Cross bars having opposite ends pivoted to the rods respectively are arranged above and below the crossing point of the rods. Swinging one of the rods by the weight of the person sitting on the chair causes the other rod to move therewith and back-and-forth swinging of the rods leads to rocking motion of the chair.

An additional cross bar is provided between two spaced rods of the chair for limiting the movement of the other rods and thus preventing the chair from over-tilting. This, however, requires additional expenses in manufacturing. In addition, the length of the rods and the relative position of the crossing point must be carefully selected. Otherwise, turnover may occur, causing the person sitting on the chair to fall and hurt.

Thus, the present invention is aimed to provide a foldable rocking chair of the mentioned structure but having improved turnover protection design.

SUMMARY OF THE INVENTION

Therefore, a primary object of the present invention is to provide a foldable rocking chair having a rocking stop that provides excellent turnover protection.

Another object of the present invention is to provide a foldable rocking chair having a comfortable support for legs of a person sitting thereon.

A further object of the present invention is to provide a foldable rocking chair having an adjustable backrest and headrest.

To achieve the above objects, in accordance with the present invention, there is provided a foldable rocking chair comprising a chair frame comprised of first and second U-shaped members each having opposite side bars connected by a bottom bar and arranged to cross each other, a stretcher bar having opposite ends pivoted to the side bars at a location below the crossing of the side bars, an armrest in the form of an L-shape pivoted to the side bars at a location above the crossing of the side bars and a primary cross bar extending between and fixed to free ends of the side bars of the first U-shaped member and adjacent to the pivot connection between the armrest and the side bars whereby when the side bars of the first U-shaped member are rocked frontward, the armrests are moved toward and eventually contact the primary cross bar to stop the frontward rocking motion of the first U-shaped member. A flexible sheet is attached to the chair frame with adjustable headrest and adjustable lower back rest cushions for supporting a person thereon.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 6:
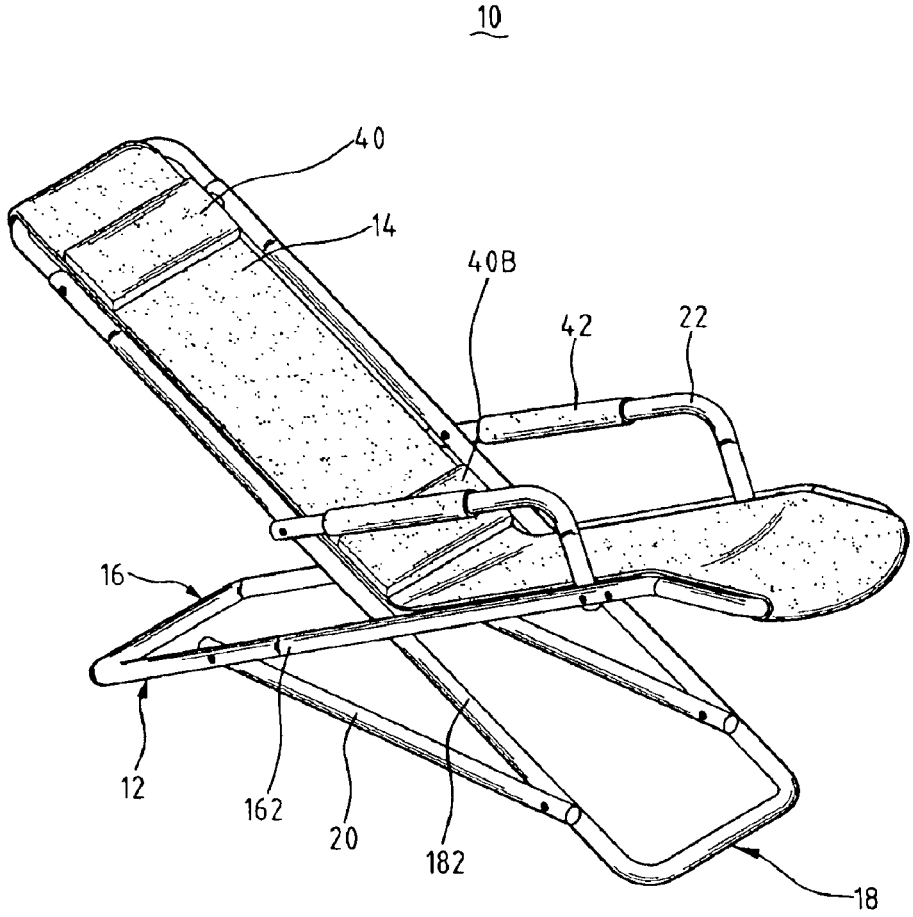
FIG. 6 is a perspective view of the foldable rocking chair in accordance with the present invention in the expanded condition.

With reference to the drawings and in particular to FIG. 6, a foldable rocking chair constructed in accordance with the present invention, generally designated with reference numeral 10, comprises a foldable frame 12 to which a piece of flexible sheet 14 is attached to support a person (not shown) thereon.

Figure 1:
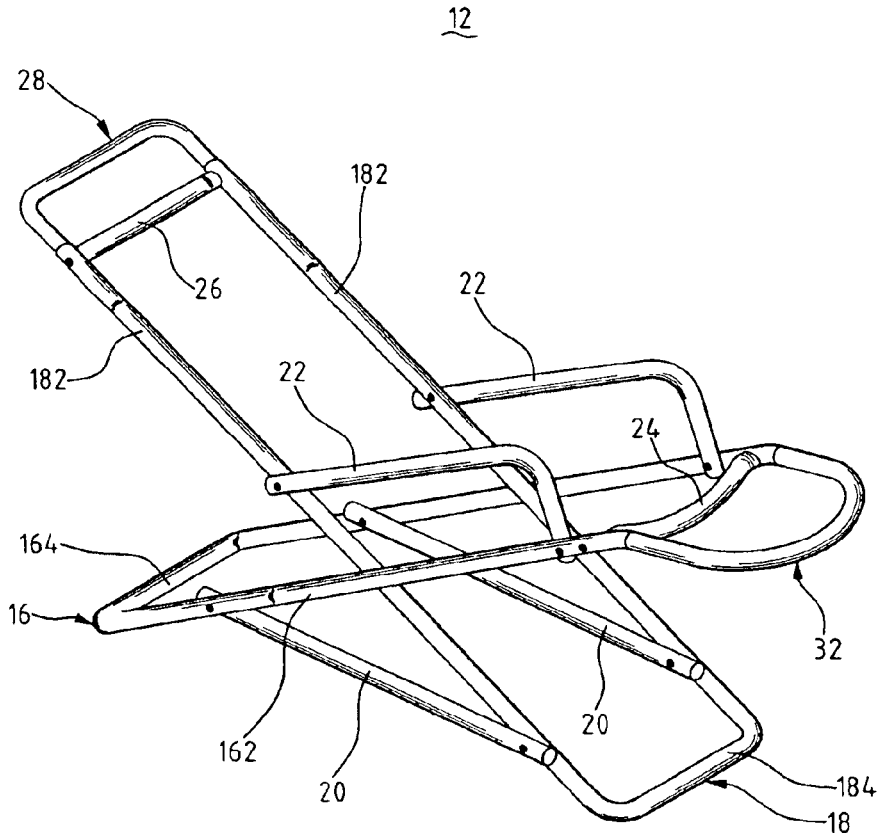
FIG. 1 is a perspective view of a frame of a foldable rocking chair constructed in accordance with the present invention in an expanded condition.
Figure 2:
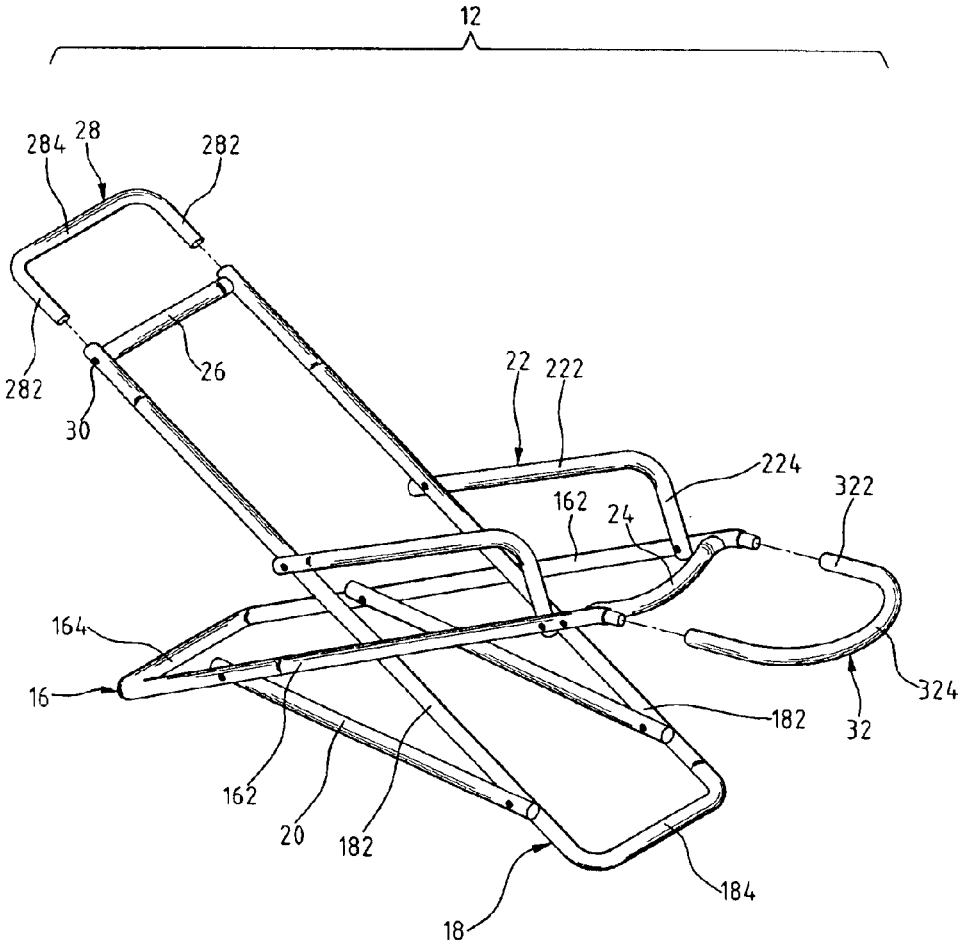
FIG. 2 is similar to FIG. 1 but showing a leg support and a head support detached from the chair frame.

Also referring to FIGS. 1 and 2, the chair frame 12 comprises first and second U-shaped members 16, 18 each having two side bars 162, 182 that are substantially parallel to and spaced from each other and connected by a bottom bar 164, 184 extending between lower ends of the side bars 162, 182. The bottom bar 184 of the second U-shaped member 18 is shorter than the bottom bar 164 of the first U-shaped member 16 whereby the second side bars 182 of the second U-shaped member 18 are received between the first side bars 162 of the first U-shaped member 16. Each first side bar 162 and an associated second side bar 182 form a cross, but are not jointed to each other at the crossing point. The bottom bars 164, 184 are positionable on a fixture surface, such as ground, to support the foldable rocking chair 10 on the fixture surface.

A stretcher bar 20 is connected between each first side bar 162 and the associated second side bar 182 by having opposite ends thereof pivoted to the fist and second side bars 162, 182 below the crossing point of the side bars 162, 182. An L-shaped bar 22, also functioning as an arm rest, is also connected between each first side bar 162 and the associated second side bar 182 by also having ends thereof pivoted to the side bars 162, 182 above the crossing point of the side bars 162, 182. The stretcher bar 20 and the armrest 22 are located on opposite sides of the crossing point of the side bars 162, 182.

A first cross bar 24 is fixed to and extends between upper ends of the first side bars 162. Similarly, a second cross bar 26 is fixed to and extends between upper ends of the second side bars 182. The cross bars 24, 26 function to stabilize the structure.

A head support member 28, having a U-shaped comprised of two limbs 282 connected by a bottom 284, is releasably and movably mounted to the upper ends of the second side bars 182. In this respect, the first side bars 182 are tubular and form openings on the upper ends into which the limbs 282 of the head support member 28 are telescopically fit. Fasteners 30, such as spring-biased pin or snap-on elements, are provided between the first side bars 182 and the limbs 282 of the head support member 28 whereby the relative position of the head support member 28 is adjustable with respect to the first side bars 182. Thus, when a person sits on the chair 10, the upper sections of the first side bars 182 function as a backrest to which the head support member 28 is attached. The adjustment of the position of the head support member 28 allows for variation of the length of the backrest for users having different heights.

A leg support member 32, also in the form of a U-shape comprised of opposite limbs 322 connected by a bottom 324, is releasably mounted to the upper ends of the first side bars 162 for supporting the legs of the person sitting on the chair 10. The leg support frame 32 is not coplanar with the first U-shaped member 12 and is arranged at an angle with respect to the first side bars 162 to make the person sitting on the chair 10 comfortable. For example, the first side bars 162 are inclined with respect to the ground, which is assumed horizontal, and the leg support member 32 is positioned horizontally, thus forming an angle with respect to the first side bars 162. The limbs 322 of the leg support member 32 may be tubular into which the upper ends of the first side bars 162 are telescopically fit for fixing the leg support member 32 to the first side bars 162.

For leg comfort, the first cross bar 24 and the leg support member 32 are made curved or concave, as illustrated in the drawings.

Figure 3:
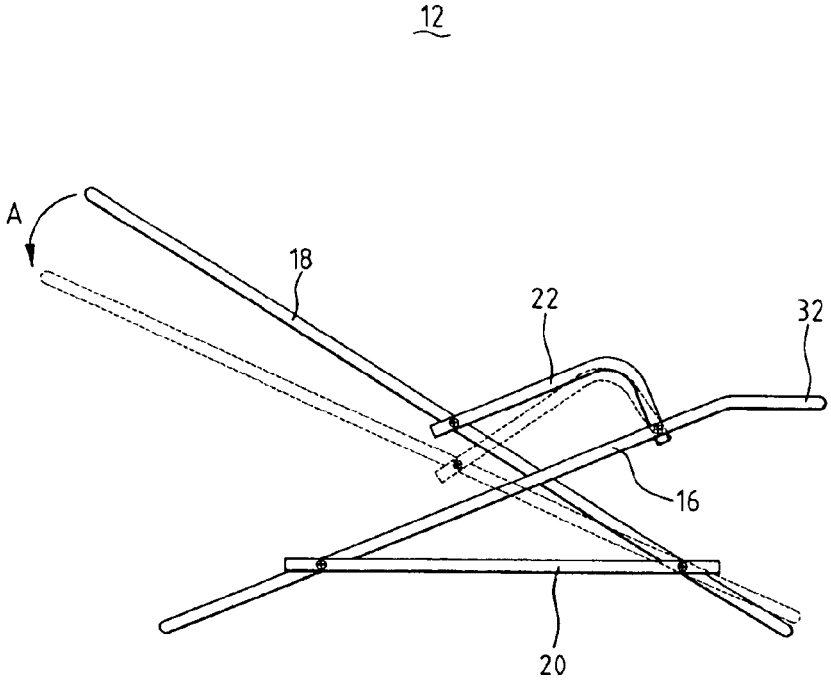
FIG. 3 is a side elevational view of the foldable rocking chair, illustrating a downward movement of the chair.
Figure 4:
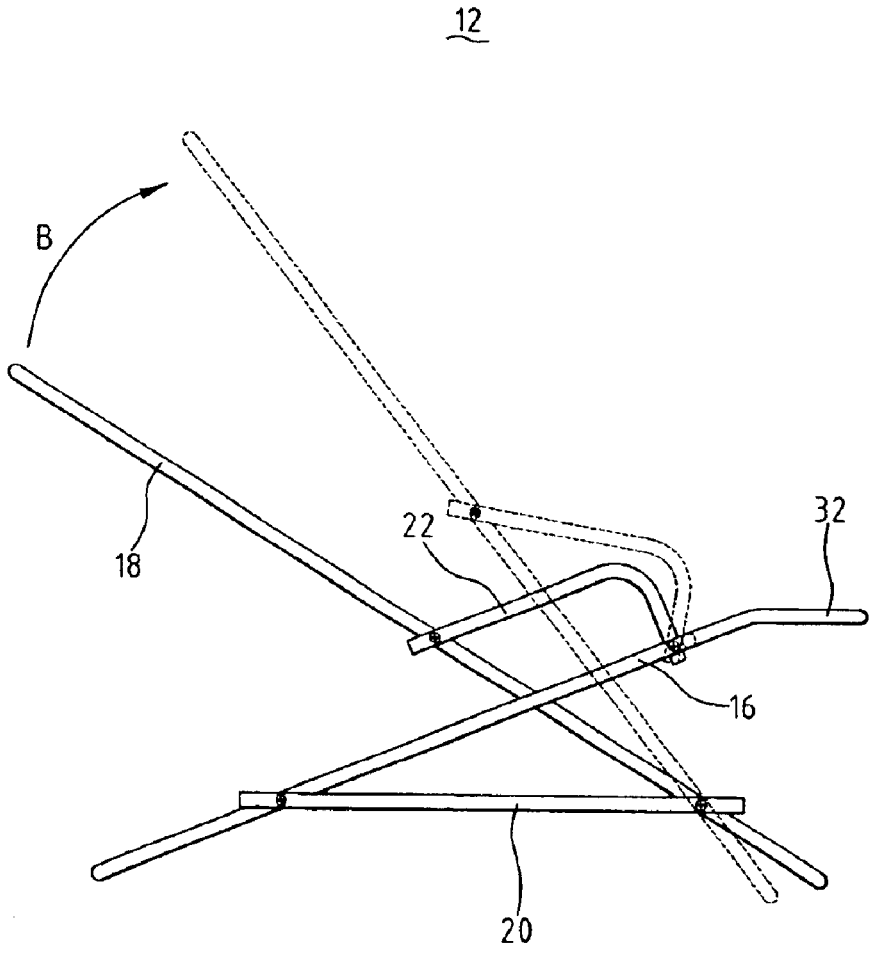
FIG. 4 is similar to FIG. 3, but showing an upward movement of the chair.

Also referring to FIGS. 3 and 4, when a person sitting on the foldable rocking chair 10 moves his or her center of gravity backward, the second side bars 182 that constitute the backrest are depressed downward and rearward as indicated by arrow A of FIG. 3 from the position indicated by solid lines to the position indicated by phantom lines. Due to the movement of the second side bars 182, the armrests 22 that connect between the first and second side bars 162, 182 force the first side bars 162 to move upward and rearward. On the other hand, when the person moves his or her center of gravity frontward, the second side bars 182 are driven upward and frontward as indicated by arrow B of FIG. 4 from the position indicated by solid lines to the position indicated by phantom lines. Due to the movement of the second side bars 182, the armrests 22 that connect between the first and second side bars 162, 182 force the first side bars 162 to move downward and frontward. As a consequence, the chair 10 rocks back and forth if the person repeatedly moves his or her center of gravity frontward and rearward.

To prevent over-tilting of the rocking chair 10 in the frontward direction, the L-shaped armrests 22, which are comprised of first and second sections 222, 224 substantially perpendicular to each other, are mounted to the associated first and second side bars 162, 182 in such a way that the second section 224 of each armrest 22 is pivoted to the first side bar 162 at a position close to the first cross bar 24. When the chair 10 is rocked forward, as shown in FIG. 4, the second section 224 of the armrest 22 approaches the first cross bar 24 and eventually gets into contact with the first cross bar 24 thereby limiting further forward rocking motion of the chair 10. Over-tilting in the frontward direction is thus effectively prevented.

As compared to the conventional foldable rocking chair, such as U.S. Pat. No. 6,398,298B1, which adds an extra cross bar below the crossing point between first and second side bars to stop the frontward rocking motion of the chair, the rocking chair 10 in accordance with the present invention can be of simpler structure by completely eliminating the extra cross bar.

Figure 5:
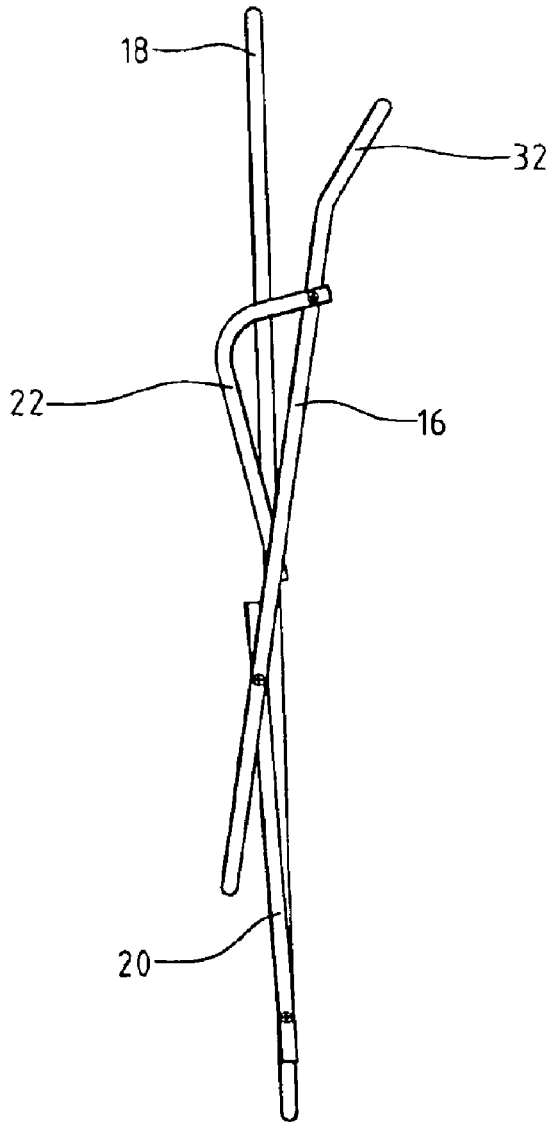
FIG. 5 is a side elevational view showing the foldable rocking chair of the present invention in a collapsed condition.

To collapse the foldable rocking chair 10, upper portions of the first and second side bars 162, 182, namely the portions above the crossing point between the side bars 162, 182, are moved toward each other, the pivotal connection between the stretcher bars 20 and the armrests 22 and the first and second side bars 162, 182 causing the stretcher bars 20 and the armrests 22 to flow the motion of the first and second side bars 162, 182. Eventually, the first and second side bars 162, 182 and the stretcher bars 20 and the armrests 22 substantially overlap each other and the collapsing of the chair 10 is completed as shown in FIG. 5.

Referring back to FIG. 6, the flexible sheet 14 have opposite ends respectively attached to the head support member 28 and the leg support member 32. Preferably, a head cushion pad 40 is mounted to the flexible sheet 14 at a location corresponding to the head support member 28 and the second cross bar 26 for providing comfortable support to the head of the person sitting on the chair 10. Arm cushions 42 are selectively attached to the armrests 22 for supporting the arms of the person.

A back cushion 40B is selectively attached to the flexible sheet 14 for support lower back of the person. Preferably, the back cushion 40B and the head cushion 40 are made position adjustable, for example, by means of the adjustment of the head support member 28. Alternatively, the cushions 40, 40B can be made detachable from and re-attachable to the flexible sheet 14. Other means or structure for adjusting position of the cushions 40, 40B along the length of the flexible sheet 14 may also be employed, if appropriate.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A foldable rocking chair comprising:

a chair frame comprising:

first and second U-shaped members comprised of first and second side bars connected by first and second bottom bars, respectively, the second side bars being received between the first side bars in a crossing fashion, the first and second bottom bars being positionable on a fixture surface to support the chair;

a stretcher bar having opposite ends pivoted to each first side bar and the associated second side bar at a location below the crossing of the first and second side bars;

an L-shaped armrest having first and second sections respectively pivoted to the second and first side bars at a location above the crossing of the first and second side bars;

a primary cross bar extending between and fixed to free ends of the first ends of the first side bars and adjacent to the pivot connection between the armrest and the first side bar whereby when the first side bars are rocked frontward, the second sections of the armrests are moved toward and eventually contact the primary cross bar to stop the frontward rocking motion of the fist side bars;

a flexible sheet attached to the chair frame for supporting a person thereon, the flexible sheet comprising at least one adjustable headrest and backrest cushion;

a head support member movable connected to free ends of the second side bars; and a leg support member mounted to free ends of the first side bars and adapted to support legs of a person sitting on the chair.

2. The foldable rocking chair as claimed in claim 1, wherein the free ends of the second side bars are tubular and wherein the head support member comprises a U-shaped having opposite limbs telescopically received in the free ends of the second side bars.

3. The foldable rocking chair as claimed in claim 1, wherein the leg support member is U-shaped, having a curved and concave bottom and opposite tubular limbs telescopically receiving the free ends of the fist side bars therein.

4. The foldable rocking chair as claimed in claim 1, wherein the leg support member is attached to the fist side bars at a predetermined angle.

5. The foldable rocking chair as claimed in claim 1, wherein the at least one head cushion pad and a back rest cushion includes both the head cushion pad and the back cushion pad, both pads are position adjustable and are formed on the flexible sheet.

6. The foldable rocking chair as claimed in claim 1, further comprising arm cushions mounted to the armrests.

7. The foldable rocking chair as claimed in claim 1, further comprising a secondary cross bar connected between free ends of the second side bars.

* * * * *